US011427903B2

(12) United States Patent
Wang et al.

(10) Patent No.: US 11,427,903 B2
(45) Date of Patent: Aug. 30, 2022

(54) HIGH-STRENGTH AND HIGH-CONDUCTIVITY CU—AG—SC ALLOY AND PREPARATION METHOD THEREOF

(71) Applicant: Northeastern University, Shenyang (CN)

(72) Inventors: Engang Wang, Shenyang (CN); Bailing An, Shenyang (CN); Lin Zhang, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 0 days.

(21) Appl. No.: 17/266,921

(22) PCT Filed: Apr. 23, 2020

(86) PCT No.: PCT/CN2020/086262
§ 371 (c)(1),
(2) Date: Feb. 8, 2021

(87) PCT Pub. No.: WO2020/228503
PCT Pub. Date: Nov. 19, 2020

(65) Prior Publication Data

US 2021/0340658 A1 Nov. 4, 2021

(30) Foreign Application Priority Data

May 15, 2019 (CN) ..... 201910401815.3

(51) Int. Cl.
*C22F 1/08* (2006.01)
*C22C 1/03* (2006.01)
(Continued)

(52) U.S. Cl.
CPC ..... *C22F 1/08* (2013.01); *C22C 1/03* (2013.01); *C22C 9/00* (2013.01); *C22F 1/02* (2013.01)

(58) Field of Classification Search
USPC ..... 75/314
See application file for complete search history.

(56) References Cited

U.S. PATENT DOCUMENTS

2006/0239853 A1* 10/2006 Maehara ..... C22F 1/002 420/492

FOREIGN PATENT DOCUMENTS

CN 1380431 A 11/2002
CN 1775989 A 5/2006
(Continued)

OTHER PUBLICATIONS

Gaganov, A. et al., "Effect of Zr additions on the microstructure, and the mechanical and electrical properties of Cu-7 wt.%Ag alloys," Materials Science and Engineering A, 2006, vol. 437 pp. 313-322.
Freudenberger, et al., "Non-destructive pulsed field CuAg-solenoids," Materials Science and Engineering A, 2010, vol. 527, pp. 2004-2013.
(Continued)

*Primary Examiner* — Brian D Walck
*Assistant Examiner* — Christopher D. Moody
(74) *Attorney, Agent, or Firm* — Muncy, Geissler, Olds & Lowe, P.C.

(57) ABSTRACT

Provided are a high-strength and high-conductivity Cu—Ag—Sc alloy and a preparation method thereof. The preparation method includes the following steps: (1) placing metal Ag and metal Sc in an electric-arc furnace and performing smelting under a vacuum condition, performing cooling to normal temperature in the furnace to obtain an Ag—Sc intermediate alloy; (2) placing the Ag—Sc intermediate alloy, an electrolytic copper and the metal Ag in an induction
(Continued)

furnace and performing heating to 1200-1300° C. under a vacuum condition, keeping at the temperature for 10-60 min for smelting, then performing casting and cooling to normal temperature in the furnace to obtain ingots; (3) heating the ingots to 700-850° C. under an inert atmosphere, then performing water quenching to normal temperature to obtain heat-treated ingots; and (4) heating the heat-treated ingots to 400-500° C. under an inert atmosphere, then performing air cooling to normal temperature to obtain the high-strength and high-conductivity Cu—Ag—Sc.

3 Claims, 2 Drawing Sheets

(51) Int. Cl.
*C22C 9/00* (2006.01)
*C22F 1/02* (2006.01)

(56) References Cited

FOREIGN PATENT DOCUMENTS

| | | | |
|---|---|---|---|
| CN | 1985014 | A | 6/2007 |
| CN | 104674051 | A | 6/2015 |
| CN | 105803246 | A | 7/2016 |
| CN | 105839038 | A | 8/2016 |
| CN | 106282651 | A | 1/2017 |
| CN | 110004320 | A | 7/2019 |
| WO | WO-2008/030368 | A1 | 3/2008 |

OTHER PUBLICATIONS

Liu,J. B. et al., "Effects of Cr and Zr additions on the microstructure and properties of Cu-6 wt.% Ag alloys," Materials Science and Engineering A, 2012, vol. 532, pp. 331-338.

* cited by examiner

HIGH-STRENGTH AND HIGH-CONDUCTIVITY CU—AG—SC ALLOY AND PREPARATION METHOD THEREOF

BACKGROUND OF THE INVENTION

1. Field of the Invention

The present invention relates to the technical field of non-ferrous metal alloys, and particularly relates to a high-strength and high-conductivity Cu—Ag—Sc alloy and a preparation method thereof.

2. The Prior Arts

With the development of modern industry and techniques, more and more fields need wire materials good in matching of strength and electrical conductivity. Pure copper has excellent electrical conductivity, but its strength is far from enough to meet requirements of the modern industries. Therefore, many scholars alloyed pure copper with different proportions of Ag to further improve the strength of the material.

There are two types of Ag precipitates in Cu—Ag alloys, continuous and discontinuous. The rod-like discontinuous precipitates usually appear in the Cu—Ag alloys with a low Ag content (<8 wt %) and distribute near high-angle grain boundaries. The particle-like continuous precipitates appear in high-Ag alloys (>8 wt %) and typically distribute inside grains. As such, the continuous precipitates have a higher density than the discontinuous precipitates. Numerous experiments show that the strength of Cu—Ag composites are mainly due to the high density of Ag fibers, while the density of the deformed Ag fibers has a positive correlation with the density of Ag precipitates in Cu—Ag alloys before deformation. Therefore, how to obtain a large number of continuous Ag precipitates becomes a key to improve the strength of Cu—Ag composite. The proportion of the continuous precipitates is increased with the increase in Ag content (the rule is applicable for 8-30 wt %). The cost of Ag, however, is high. Therefore, how to obtain the continuous precipitates in Cu—Ag alloys with a low Ag content becomes a hot research topic.

Chinese Patent Application No. 200510048639.8 discloses a method for obtaining a fiber-reinforced material good in matching of strength and electrical conductivity by adding Re to refine the microstructure of Cu—Ag alloys and adopting a large deformation and a reasonable heat treatment. Chinese Patent Application No. 201310614153.0 discloses a technique of improving the softening resistance and the strength at high temperature by adding Zr to Cu—Ag alloys to increase the recrystallization temperature, the creep strength and the high-temperature low-cycle fatigue resistant properties of the Cu—Ag alloys. Chinese Patent Application No. 02110785.8 discloses a method of adding a small amount of Cr, Ce, La and Nd to Cu—Ag alloys with a low Ag content. Under the conditions of lowering Ag contents and simplifying the manufacturing process, the strength and the electrical conductivity thereof reach the level of the alloys with 24-25 wt % Ag. In Chinese Patent Application No. 201610218372.0, a small amount of Fe was added to the Cu—Ag alloys. The strength of the alloys was improved with the aid of a magnetic field. Although the cost was reduced because of lower price of iron, the electrical conductivity of the Cu—Ag—Fe alloys was greatly reduced. Chinese Patent Application No. 201610173651.X discloses a technique in which Nb, Cr and Mo are added in Cu—Ag alloys and the type of Ag precipitates was controlled through a reasonable heat treatment. The Ag continuous precipitation was promoted, thereby improving the strength and the electrical conductivity of the Cu—Ag alloys. However, due to the high melting point of the third elements, the alloys were difficult to cast, which limited its application.

How to control the Ag precipitation was discussed in many academic articles. The articles from A. Gaganov, et al. (Materials Science and Engineering: A. 2006, 2: 437), J. Freudenberger, et al. (Materials Science and Engineering: A. 2010, 7-8:527), and J. B. Liu, et al. (Materials Science and Engineering: A. 2012.1, 532) disclose that the discontinuous precipitation was suppressed and the continuous precipitation was improved through adding Zr element. However, the melting point of Zr is very high (1855° C.), and its solubility with Cu and Ag is very low. These lead to the difficulty in casting a large-scale ingot required in industry production.

SUMMARY OF THE INVENTION

The present invention aims to provide a high-strength and high-conductivity Cu—Ag—Sc alloy and a preparation method thereof to solve the present technical problem. The method can improve the trade-off between the strength and the electrical conductivity in the Cu—Ag—Sc alloy by adding a small amount of Sc in Cu—Ag alloy to change the type of Ag precipitates.

The high-strength and high-conductivity Cu—Ag—Sc alloy according to the present invention comprises the following components: 1-10 wt % Ag, 0.05-0.5 wt % Sc and a balance Cu. The hardness of the Cu—Ag—Sc alloy is 88-148 HV, and the electrical conductivity is 83-88% IACS.

The preparation method of the high-strength and high-conductivity Cu—Ag—Sc alloy in the present invention comprising the following steps:

1. Place metal Ag and metal Sc in an electric-arc furnace and smelt the metal Ag and the metal Sc under a vacuum condition, then perform cooling to normal temperature in the furnace to obtain an Ag—Sc intermediate alloy. The Ag—Sc intermediate alloy includes 0.5-5 wt % Sc.

2. Place the Ag—Sc intermediate alloy, an electrolytic copper and the metal Ag in an induction furnace and perform heating to 1200-1300° C. under a vacuum condition. Keep at the temperature for 10-60 min for smelting, then perform casting and cooling to normal temperature in the furnace to obtain ingots. The components of the ingots are: 1-10 wt % Ag, 0.05-0.5 wt % Sc and a balance Cu.

3. Heat the ingots to 700-850° C. under an inert atmosphere and keep at the temperature for 1-15 h for heat treatment, then perform water quenching to normal temperature to obtain heat-treated ingots.

4. Heat the heat-treated ingots to 400-500° C. under an inert atmosphere and keep at the temperature for 2-20 h for aging treatment, then perform air cooling to normal temperature to obtain the high-strength and high-conductivity Cu—Ag—Sc alloy. Its hardness and electrical conductivity are 88-148 HV and 83-88% IACS, respectively.

The vacuum condition in the step 1 and step 2 is that the vacuum degree is smaller than or equal to $10^{-2}$ MPa.

The inert atmosphere is an argon atmosphere.

There is no research about Cu—Ag alloys added with Sc as the third element and relevant preparation technique and method in the prior art. The melting point of Sc is 1541° C., which is lower than that (1855° C.) of Zr, and Sc has certain solid solubility with Ag (the solid solubility is 4.6 wt % at 926° C.). Therefore, Sc can distribute uniformly in Cu—Ag alloy through the Ag—Sc intermediate alloy. By a reasonable heat treatment, continuous Ag precipitates are distributed in Cu matrix. Besides, Cu and Ag can form intermediate compounds with Sc, which can further improve the strength of the alloy. Therefore, the strength of the Cu—Ag—Sc alloy is remarkably higher than that of the Cu—Ag alloy under the same condition.

According to the method of the present invention, the Cu—Ag—Sc alloy has uniformly distributed components because of the Ag—Sc intermediate alloy. This solves the problem that Sc is difficult to be melted in Cu.

DETAILED DESCRIPTION OF THE PREFERRED EMBODIMENT

Figure 1:
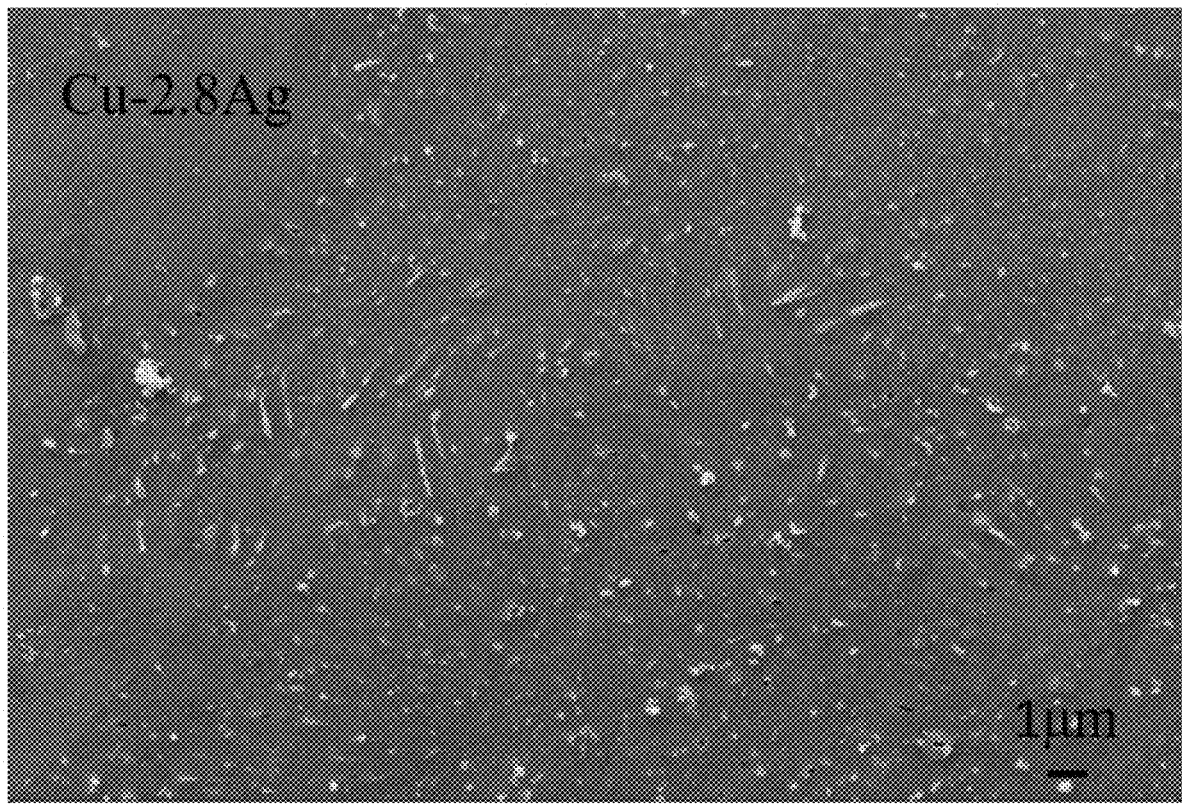
FIG. 1 shows a scanning electron microscope image of a Cu-2.8 Ag alloy obtained in a comparative test in an embodiment 2 of the present invention.

In embodiments of the present invention, hardness is measured with a micro-hardness tester, and the electrical conductivity is tested by a four-point probe method.

The metal Ag used in the embodiments of the present invention is silver bars, and the purity is 99.990-99.998%.

The purity of the metal Sc used in the embodiments of the present invention is 99.75-99.99%.

The purity of electrolytic copper used in the embodiments of the present invention is 99.95-99.99%.

The following are preferable embodiments of the present invention.

Embodiment 1

Metal Ag and metal Sc were placed in an electric-arc furnace and smelted under a vacuum condition, in which the vacuum degree is smaller than or equal to $10^{-2}$ MPa, then, cooled to normal temperature in the furnace to obtain an Ag—Sc intermediate alloy, wherein the Ag—Sc intermediate alloy includes 5 wt % Sc.

The Ag—Sc intermediate alloy, an electrolytic copper and the metal Ag were placed in an induction furnace, heated to 1300° C. under a vacuum condition, in which the vacuum degree is smaller than or equal to $10^{-2}$ MPa, kept at the temperature for 15 min for smelting, then, casted and cooled to normal temperature in the furnace to obtain ingots. The components of the ingots are: 1 wt % Ag, 0.1 wt % Sc and the balance Cu;

The ingots were heated to 800° C. under an inert atmosphere and kept at the temperature for 4 h for heat treatment, then, water quenched to normal temperature to obtain heat-treated ingots.

The heat-treated ingots were heated to 475° C. under an argon atmosphere and kept at the temperature for 4 h for aging treatment, then, air cooled to normal temperature to obtain the high-strength and high-conductivity Cu—Ag—Sc alloy. Its hardness is 88 HV, and its electrical conductivity is 87.5% IACS.

Embodiment 2

The method according to the embodiment 2 is the same as that in Embodiment 1 but has the following different points:

(1) The Ag—Sc intermediate alloy includes 3 wt % Sc;

(2) In an induction furnace, the temperature was heated to 1250° C., and the time was kept for 20 min for smelting. The ingots were cooled to normal temperature in the furnace. The components of the ingots are: 2.8 wt % Ag, 0.2 wt % Sc and the balance Cu;

(3) The ingots were heated to 760° C., and kept at the temperature for 2 h; and (4) The ingots were aged at 450° C. and kept at the temperature for 8 h. Its hardness and electrical conductivity were 108 HV and 88% IACS, respectively.

Figure 2:
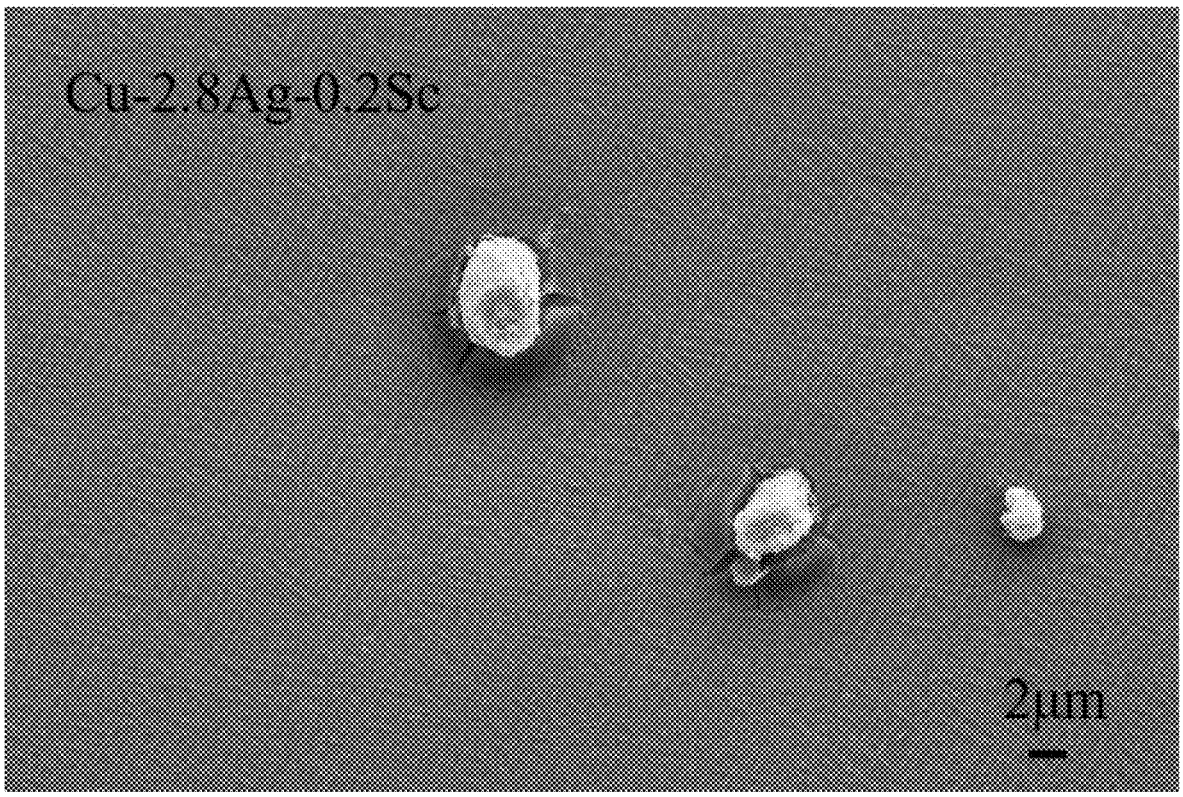
FIG. 2 shows a scanning electron microscope image of a high-strength and high-conductivity Cu-2.8 Ag-0.2 Sc alloy in the embodiment 2 of the present invention.

Compared with the hardness of Cu-2.8 Ag alloy without Sc, the hardness of Cu-2.8 Ag-0.2 Sc alloy was increased by 44.6%, the scanning electron microscope image of the Cu-2.8 Ag alloy was shown in FIG. 1, and the scanning electron microscope image of the high-strength and high-conductivity Cu—Ag—Sc alloy was shown in FIG. 2. According to FIGS. 1 and 2, the Cu-2.8 Ag-0.2 Sc alloy only had a fine uniform continuous Ag precipitates, but the Cu-2.8 Ag alloy had coarse discontinuous Ag precipitates.

The hardness of the Cu-2.8 Ag-0.2 Sc alloy was higher than that of the Cu-2.8 Ag alloy. After aging treatment at 450° C., the hardness of the Cu-2.8 Ag-0.2 Sc alloy was 108HV and increased 44.6% relative to the Cu-2.8 Ag alloy under the same condition. From the scanning electron microscope image, the Cu-2.8 Ag-0.2 Sc alloy only had fine uniform continuous Ag precipitates, but the Cu-2.8 Ag alloy had coarse discontinuous Ag precipitates (FIG. 1 and FIG. 2).

Embodiment 3

The method according to the embodiment 3 is the same as that in Embodiment 1 but has the following different points:

(1) The Ag—Sc intermediate alloy includes 5 wt % Sc;

(2) In an induction furnace, the temperature was heated to 1250° C., and the time was kept for 15 min for smelting. The ingots were cooled to normal temperature in the furnace. The components of the ingots are: 3 wt % Ag, 0.4 wt % Sc and the balance Cu;

(3) The ingots were heated to 760° C., and kept at the temperature for 10 h; and (4) The ingots were aged at 450° C. and kept at the temperature for 4 h. Its hardness and electrical conductivity were 115 HV and 84% IACS, respectively.

Embodiment 4

The method according to the embodiment 4 is the same as that in Embodiment 1 but has the following different points:

(1) The Ag—Sc intermediate alloy includes 2 wt % Sc;

(2) In an induction furnace, the temperature was heated to 1300° C., and the time was kept for 20 min for smelting. The ingots were cooled to normal temperature in the furnace. The components of the ingots are: 7 wt % Ag, 0.07 wt % Sc and the balance Cu;

(3) The ingots were heated to 760° C., and kept at the temperature for 6 h; and (4) The ingots were aged at 450° C. and kept at the temperature for 16 h. Its hardness and electrical conductivity were 148 HV and 83% IACS, respectively.

What is claimed is:

1. A preparation method of a Cu—Ag—Sc alloy, comprising the following steps:

(1) placing metal Ag and metal Sc in an electric-arc furnace and smelting the metal Ag and the metal Sc under a vacuum condition, then performing cooling to normal temperature in the electric-arc furnace to obtain an Ag—Sc intermediate alloy, wherein the Ag—Sc intermediate alloy includes 0.5-5 wt % Sc;

(2) placing the Ag—Sc intermediate alloy, an electrolytic copper and metal Ag in an induction furnace and performing heating to 1200-1300° C. under a vacuum condition, keeping at the temperature for 10-60 min for smelting, then performing casting and cooling to normal temperature in the induction furnace to obtain ingots, wherein the components of the ingots are: 1-10 wt % Ag, 0.05-0.5 wt % Sc and a balance Cu;

(3) heating the ingots to 700-850° C. under an inert atmosphere and keeping at the temperature for 1-15 h for heat treatment, then performing water quenching to normal temperature to obtain heat-treated ingots; and (4) heating the heat-treated ingots to 400-500° C. under an inert atmosphere and keeping at the temperature for 2-20 h for aging treatment, then performing air cooling to normal temperature to obtain the Cu—Ag—Sc alloy, wherein hardness and electrical conductivity of the Cu—Ag—Sc alloy are 88-148 HV and 83-88% IACS, respectively.

2. The method according to claim 1, wherein the vacuum condition in step (1) and step (2) is that a vacuum degree is smaller than or equal to $10^{-2}$ MPa.

3. The method according to claim 1, wherein the inert atmosphere in the step (3) is an argon atmosphere.

* * * * *